US009280922B1

(12) United States Patent
Chery

(10) Patent No.: US 9,280,922 B1
(45) Date of Patent: Mar. 8, 2016

(54) FLAG-BLOWING FLAGPOLE ASSEMBLY

(71) Applicant: Nickenson R. Chery, Miami Gardens, FL (US)

(72) Inventor: Nickenson R. Chery, Miami Gardens, FL (US)

( * ) Notice: Subject to any disclaimer, the term of this patent is extended or adjusted under 35 U.S.C. 154(b) by 280 days.

(21) Appl. No.: 14/019,629

(22) Filed: Sep. 6, 2013

(51) Int. Cl.
*G09F 17/00* (2006.01)

(52) U.S. Cl.
CPC ..... *G09F 17/00* (2013.01); *G09F 2017/0016* (2013.01); *G09F 2017/0025* (2013.01)

(58) Field of Classification Search
CPC ..... G09F 17/00; G09F 17/0091; G09F 2017/0016; G09F 2017/0025
USPC ..... 116/173; 40/218
See application file for complete search history.

(56) References Cited

U.S. PATENT DOCUMENTS

| | | | | | |
|---|---|---|---|---|---|
| 1,725,250 | A | | 8/1929 | Burgess | |
| 2,270,753 | A | | 1/1942 | Fikes | |
| 2,870,559 | A | | 1/1959 | Shaughnessy | |
| 3,477,161 | A | | 11/1969 | Drexler | |
| 3,952,695 | A | * | 4/1976 | Vollstedt | 116/173 |
| 5,042,418 | A | * | 8/1991 | Hoover et al. | 116/173 |
| 5,096,022 | A | * | 3/1992 | Bowers | 188/65.1 |
| 5,398,638 | A | | 3/1995 | Bonk | |
| 5,427,050 | A | | 6/1995 | Horn | |
| 5,509,371 | A | * | 4/1996 | Phillips | 116/173 |
| 6,086,448 | A | | 7/2000 | Ibanez | |
| 6,622,649 | B1 | | 9/2003 | Shaw | |
| 7,017,510 | B1 | | 3/2006 | Nair | |
| 7,432,820 | B1 | * | 10/2008 | Phan et al. | 340/679 |
| 8,215,807 | B1 | * | 7/2012 | Brunesti | 362/431 |
| 8,973,517 | B1 | * | 3/2015 | Bort | 116/173 |
| 2006/0088292 | A1 | * | 4/2006 | Guillen et al. | 386/96 |
| 2007/0283875 | A1 | * | 12/2007 | Durkin | 116/173 |
| 2011/0094133 | A1 | | 4/2011 | Amalaha | |

FOREIGN PATENT DOCUMENTS

| | | | | | |
|---|---|---|---|---|---|
| CN | 202473159 | U | * | 10/2012 | G09F 17/00 |
| DE | 3939085 | A1 | * | 5/1991 | E04H 12/32 |
| DE | 29513087 | U1 | * | 1/1996 | G09F 17/00 |
| DE | 202009005539 | U1 | * | 7/2009 | G09F 17/00 |
| KR | 100510214 | B1 | * | 8/2005 | G09F 17/00 |
| WO | WO 2006099806 | A1 | * | 9/2006 | G09F 17/00 |

* cited by examiner

*Primary Examiner* — R. A. Smith

(57) ABSTRACT

A flag-blowing flagpole assembly creates the appearance that a flag is blowing in a breeze while also emitting audible sounds. The assembly includes a pole and a flag coupled to the pole. A motor is positioned within an interior of the pole. A plurality of fan blades is coupled to the motor. The fan blades are mechanically coupled to the motor wherein actuation of the motor causes the fan blades to rotate such that the fan blades direct a flow of air into the interior of the pole. A plurality of outlet holes is positioned in the pole. The flag is positionable adjacent the outlet holes wherein the outlet holes permit the air generated from the fan blades to flow from the interior of the pole through the outlet holes onto the flag.

17 Claims, 7 Drawing Sheets

FLAG-BLOWING FLAGPOLE ASSEMBLY

BACKGROUND OF THE DISCLOSURE

Field of the Disclosure

The disclosure relates to flagpole assemblies and more particularly pertains to a new flagpole assembly for creating the appearance that a flag is blowing in a breeze while also emitting audible sounds.

SUMMARY OF THE DISCLOSURE

An embodiment of the disclosure meets the needs presented above by generally comprising a pole and a flag coupled to the pole. A motor is positioned within an interior of the pole. A plurality of fan blades is coupled to the motor. The fan blades are mechanically coupled to the motor wherein actuation of the motor causes the fan blades to rotate such that the fan blades direct a flow of air into the interior of the pole. A plurality of outlet holes is positioned in the pole. The flag is positionable adjacent the outlet holes wherein the outlet holes permit the air generated from the fan blades to flow from the interior of the pole through the outlet holes onto the flag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
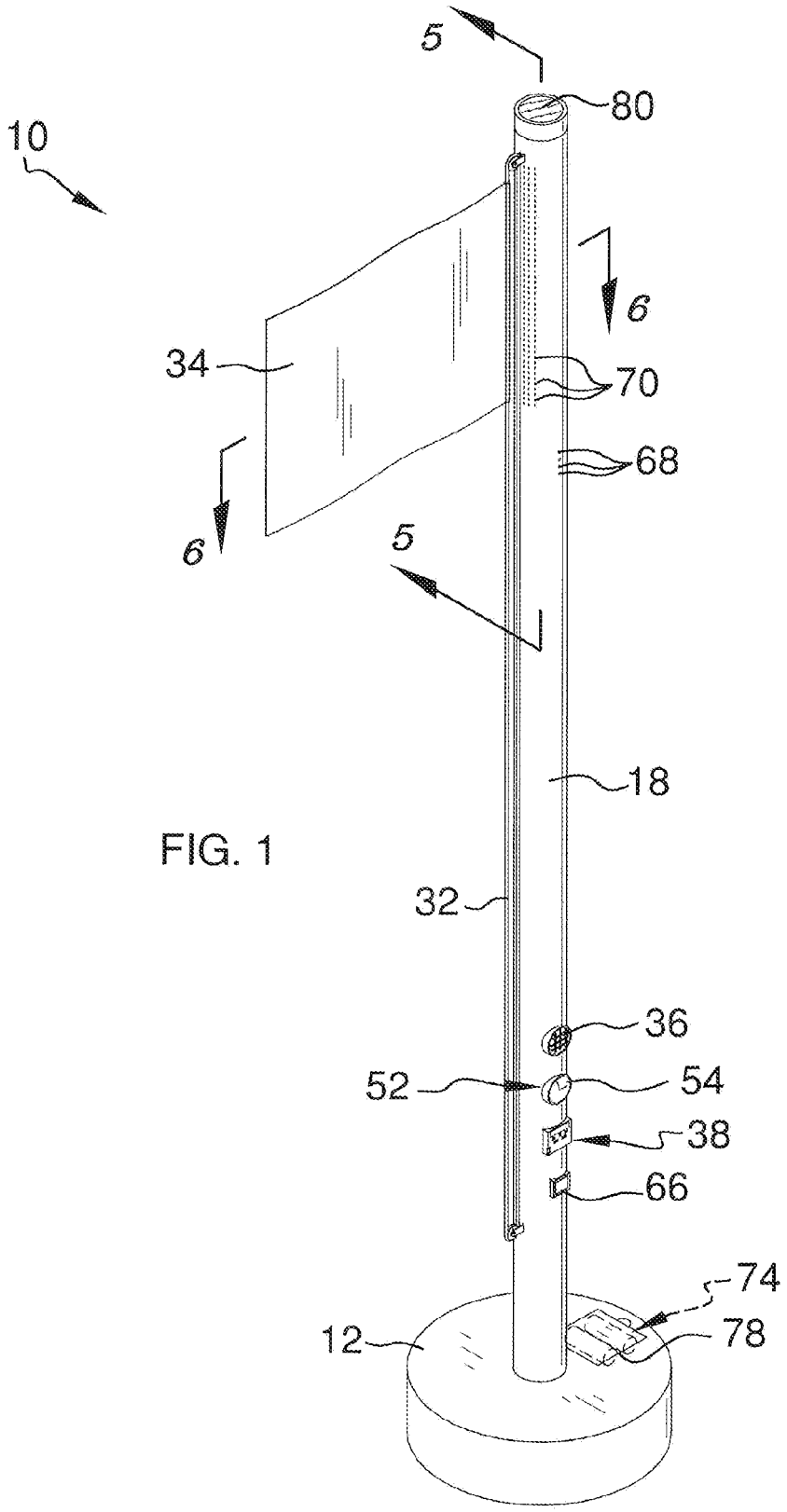
FIG. 1 is a top front side perspective view of a flag-blowing flagpole assembly according to an embodiment of the disclosure.
Figure 2:
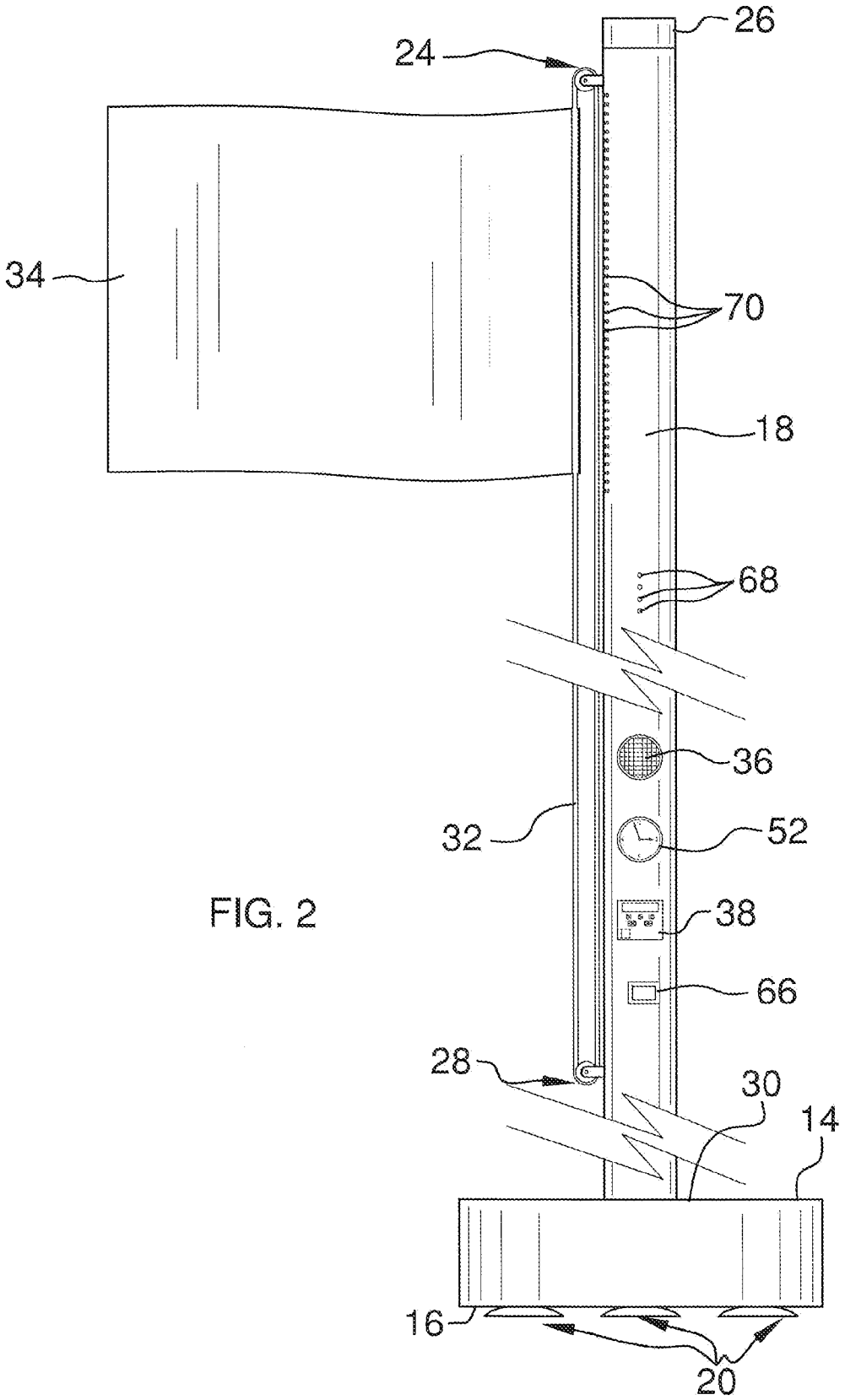
FIG. 2 is a side view of an embodiment of the disclosure.
Figure 3:
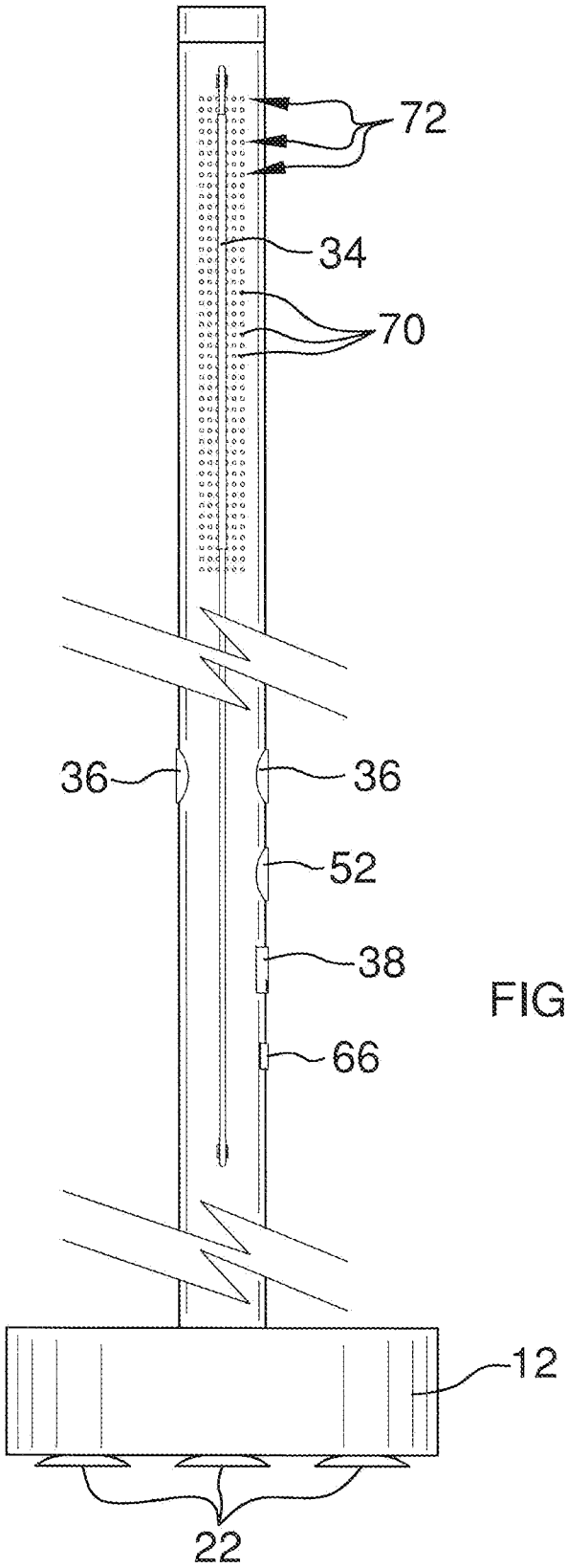
FIG. 3 is a front view of an embodiment of the disclosure.
Figure 4:
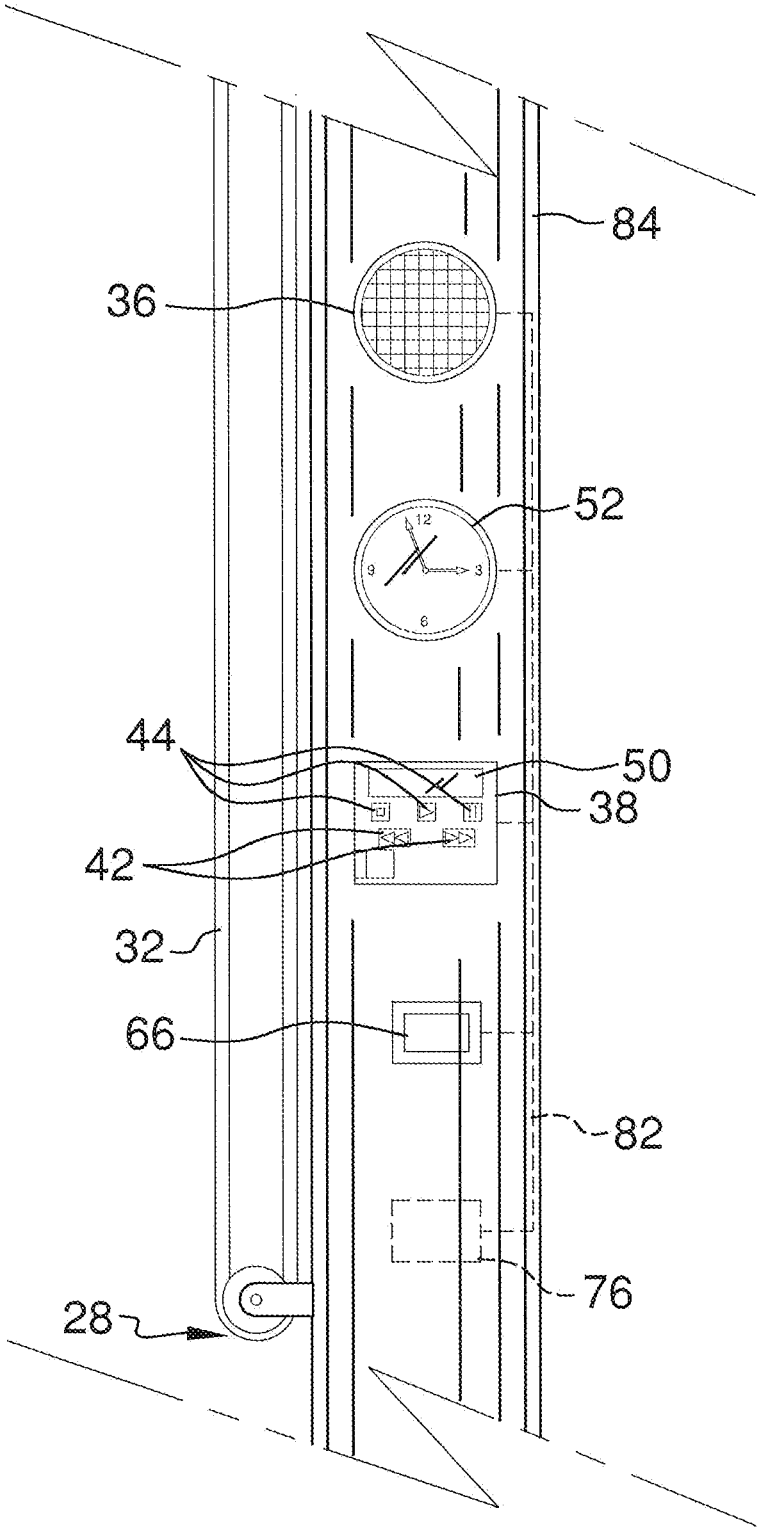
FIG. 4 is a cut-away side view of an embodiment of the disclosure.
Figure 5:
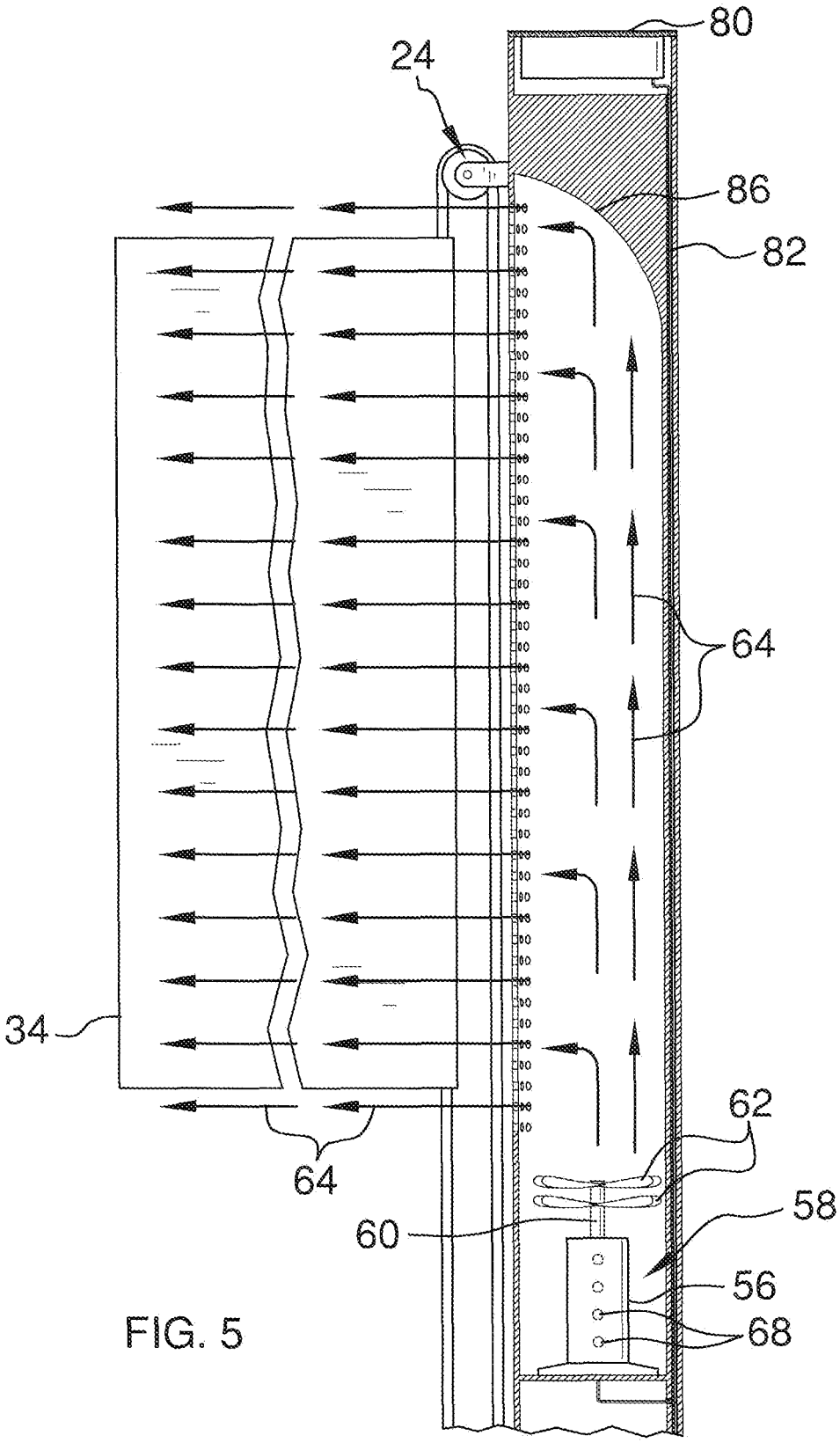
FIG. 5 is a cross-sectional view of an embodiment of the disclosure taken along line 5-5 of FIG. 1.
Figure 6:
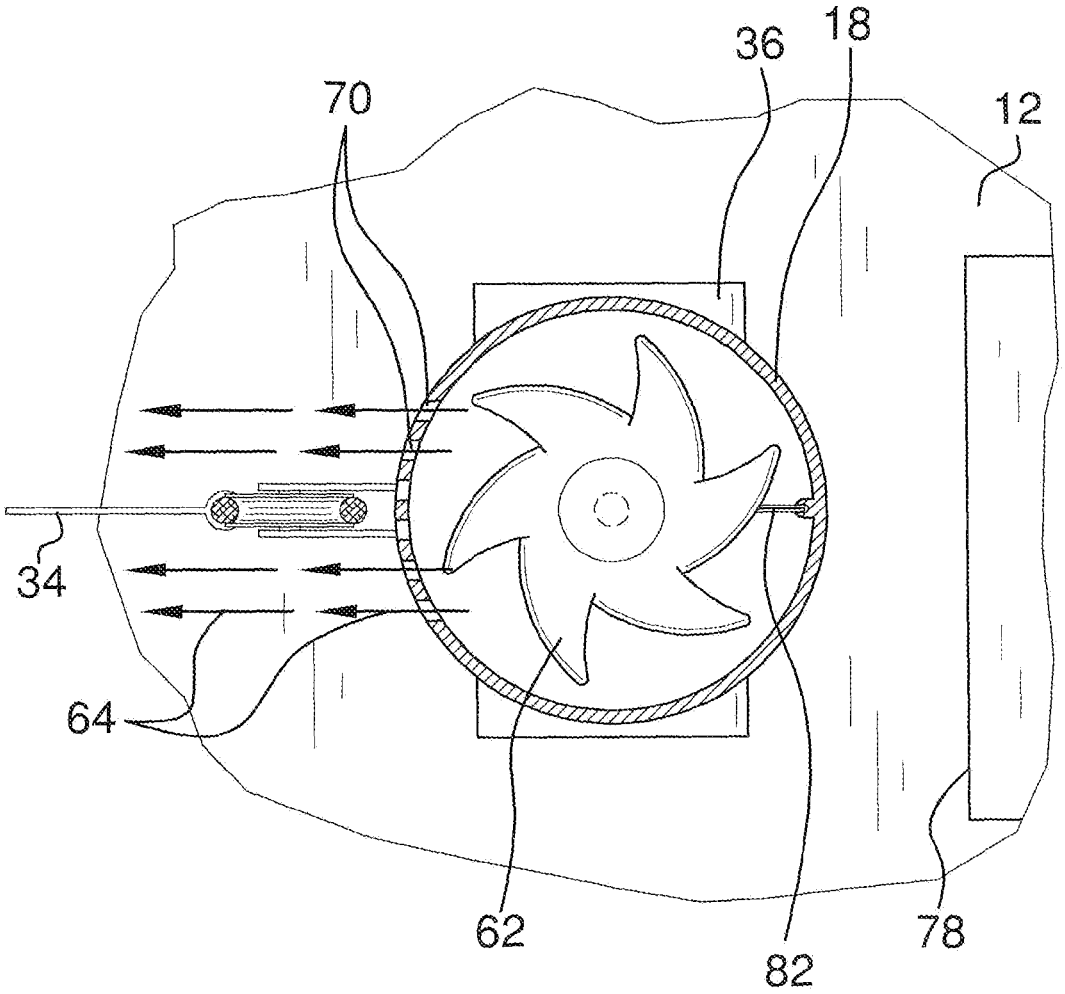
FIG. 6 is a cross-sectional view of an embodiment of the disclosure taken along line 6-6 of FIG. 1.
Figure 7:
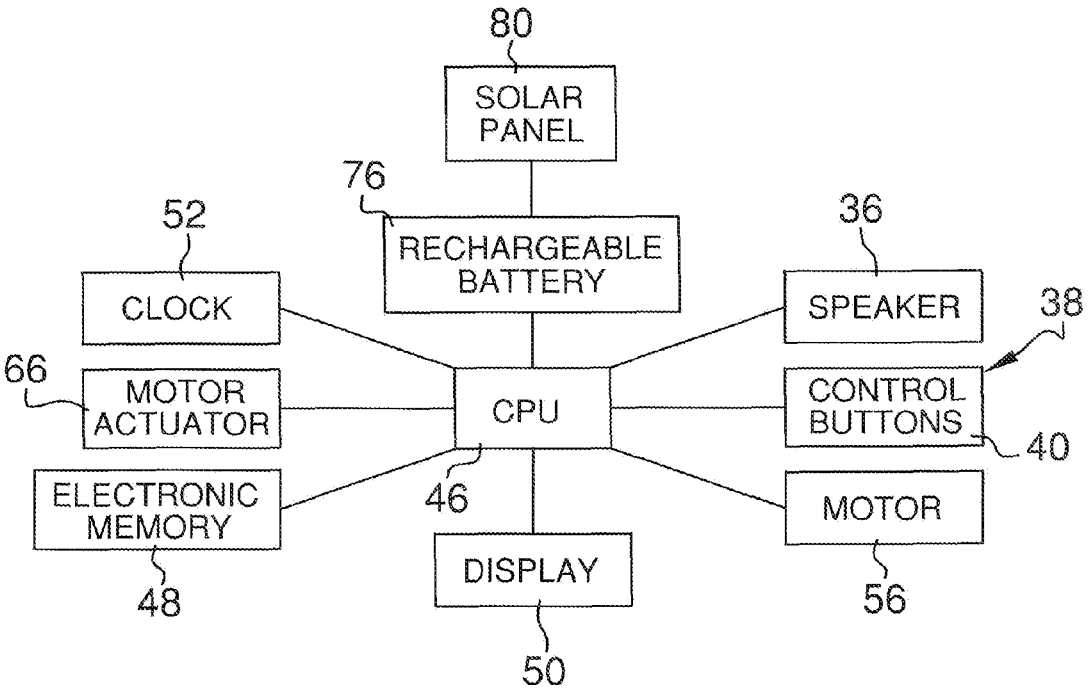
FIG. 7 is a schematic block diagram of an embodiment of the disclosure.

With reference now to the drawings, and in particular to FIGS. 1 through 7 thereof, a new flagpole assembly embodying the principles and concepts of an embodiment of the disclosure and generally designated by the reference numeral 10 will be described.

As best illustrated in FIGS. 1 through 7, the flag-blowing flagpole assembly 10 generally comprises a base 12 having a top side 14 and a bottom side 16. A pole 18 is attached to and extends upwardly from the top side 14. A plurality of grips 20 is attached to the bottom side 16. Each of the grips 20 may be comprised of a non-slip material, in particular, the grips 20 may comprise suctions cups 22.

An upper pulley 24 is coupled to and extends outwardly from the pole 18 proximate a top end 26 of the pole 18. A lower pulley 28 is coupled to and extends outwardly from the pole 18 proximate a bottom end 30 of the pole 18. The upper pulley 24 is horizontally aligned relative to the lower pulley 28. A rope 32 extends between and around the upper 24 and lower 28 pulleys. The rope 32 is operationally coupled to the upper 24 and lower 28 pulleys wherein manipulation of the rope 32 rotates the rope 32 about the upper 24 and lower 28 pulleys. The rope 32 comprises a closed loop. A flag 34 is coupled to the rope 32 and may be removably coupled to the rope 32.

A speaker 36 is mounted in the pole 18 and is configured to emit audible sound. A control panel 38 is mounted to the pole 18. The control panel 38 comprises a plurality of control buttons 40. The control buttons 40 may comprise a pair of track selection buttons 42 and a plurality of playback buttons 44. A processor 46 is mounted in the control panel 38. The speaker 36 is operationally coupled to the processor 46. The control panel 38 is operationally coupled to the processor 46 wherein manipulation of the control buttons 40 controls the audible sound emitted from the speaker 36.

An electronic memory 48 is mounted in the pole 18 and is electrically coupled to the processor 46. The electronic memory 48 is configured to store a plurality of songs thereon. The songs stored on the electronic memory 48 are configured to comprise a plurality of flag anthems. The removable nature of the flag 34 allows the user to coordinate the flag 34 that is positioned on the rope 32 to correspond to the flag anthem being played. Manipulation of the track selection buttons 42 is configured to transition between the songs stored on the electronic memory 48. Manipulation of the playback buttons 44 is configured to cause the speaker 36 to selectively play the songs stored on the electronic memory 48. Thus, the playback buttons 44 may comprise a play button, a stop button and a pause button to selectively start or stop the playing of songs. A display 50 is mounted to the control panel 38. The display 50 is electrically coupled to the processor 46 and configured to display a name of the song being audibly emitted from the speaker 36. The display 50 may comprise an LCD screen or the like.

A clock 52 is mounted to the pole 18. The clock 52 is electronically configured for indicating the time of day. The clock 52 is operationally coupled to the processor 46. The processor 46 actuates the speaker 36 to emit the audible sound at a selectable time of day. The clock 52 may be analog, as shown in the Figures, or may be digital. The interior of the clock 52 may be comprised of titanium or similar material. A covering 54 is positioned around the clock 52. The covering 54 may be constructed from glass or like material. The covering 54 may be water-proof or water-resistant and may also be scratch-resistant.

A motor 56 is positioned within an interior 58 of the pole 18. A fan shaft 60 is coupled to and extends outwardly from the motor 56. The fan shaft 60 is mechanically coupled to the motor 56 wherein actuation of the motor 56 to an on position causes the fan shaft 60 to rotate. A plurality of fan blades 62 is provided. The fan blades 62 are coupled to the fan shaft 60 whereby the fan blades 62 are rotated when the fan shaft 60 is rotated such that the fan blades 62 direct a flow of air 64 into the interior 58 of the pole 18. The fan blades 62 are conventional and may be constructed from plastic, metal or the like.

A motor actuator 66 is mounted to the pole 18. The motor actuator 66 actuates the motor 56 to the on position. Each of the motor 56 and the motor actuator 66 may also be operationally coupled to the processor 46 such that the motor 56 is automatically actuated to the on position at a selectable time of day. In this manner, both the motor 56 and the speaker 36 may be automatically actuated at the same time.

A plurality of inlet holes 68 is positioned in the pole 18 adjacent the motor 56 wherein the inlet holes 68 are configured to provide ventilation to the motor 56. A plurality of outlet holes 70 is positioned in the pole 18. The outlet holes 70 are positioned proximate the top end 26 of the pole 18. The flag 34 is configured for positioning adjacent the outlet holes 70 wherein the outlet holes 70 permit the air 64 generated from the fan blades 62 to flow from the interior 58 of the pole 18 through the outlet holes 70 onto the flag 34. The outlet holes 70 may be arranged into a plurality of rows 72.

A power supply 74 is provided and may be mounted in the base 12 or the pole 18. The power supply 74 is electrically coupled to the processor 46 wherein the power supply 74 is configured to deliver power to the processor 46. The power supply 74 may comprise at least one rechargeable battery 76. The power supply 74 may also include a power cord having a male plug-in end configured for being inserted into an electrical outlet. A compartment 78 extends into the base 12 and in particular may extend into the top side 14 of the base 12. The compartment 78 is configured to store the rechargeable battery 76 therein. A solar panel 80 is attached to the pole 18. More specifically, the solar panel 80 may be attached to the top end 26 of the pole 18. The solar panel 80 is electrically coupled to the rechargeable battery 76 wherein the solar panel 80 is configured to recharge the rechargeable battery 76.

Wiring 82 may be embedded in a side wall 84 of the pole 18. The wiring 82 electrically couples the rechargeable battery 76 to the solar panel 80. The wiring 82 also electrically couples the processor 46 to each of the solar panel 80 and the rechargeable battery 76. A wind deflector 86 is positioned within the interior 58 of the pole 18. The wind deflector 86 is positioned between the motor 56 and the solar panel 80 wherein the wind deflector 86 is configured to deflect the flow of air 64 generated from the motor 56 away from the solar panel 80.

Each of the pole 18 and the base 12 may be constructed from metal, such as aluminum or the like. The base 12 may have a diameter between approximately 25.0 centimeters and 40.0 centimeters. The pole 18 may have a height between approximately 30.0 centimeters and 610.0 centimeters. The motor 56 may have a length between approximately 15.0 centimeters and 30.0 centimeters; and a width between approximately 30.0 centimeters and 60.0 centimeters. The display 50 may have a width between approximately 5.0 centimeters and 18.0 centimeters; and a length between approximately 5.0 centimeters and 22.0 centimeters. The speaker 36 may have a diameter between approximately 5.0 centimeters and 20.0 centimeters. The clock 52 may have a diameter between approximately 5.0 centimeters and 20.0 centimeters.

In use, as stated above and shown in the Figures, the flag 34 is coupled to the rope 32 and positioned near the outlet holes 70. The motor 56 is actuated to generate air 64 that flows through the interior 58 of the pole 18 and outwardly through the outlet holes 70. This causes the flag 34 to blow so that it is clearly displayed. The speaker 36 is actuated to emit audible sounds automatically at a selectable time of day or by manipulating the control buttons 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A flag-blowing flagpole assembly comprising:

a pole;

a flag coupled to said pole;

a motor positioned within an interior of said pole;

a plurality of fan blades coupled to said motor, said fan blades being mechanically coupled to said motor wherein actuation of said motor causes said fan blades to rotate such that said fan blades direct a flow of air into said interior of said pole;

a plurality of outlet holes positioned in said pole, said flag being positionable adjacent said outlet holes wherein said outlet holes permit the air generated from said fan blades to flow from said interior of said pole through said outlet holes onto said flag;

a control panel mounted to said pole, said control panel comprising a plurality of control buttons;

a processor mounted in said control panel;

a power supply being electrically coupled to said motor and said processor wherein said power supply is configured to deliver power to said motor and said processor, said power supply including at least one rechargeable battery;

a solar panel attached to said pole, said solar panel being electrically coupled to said rechargeable battery wherein said solar panel recharges said rechargeable battery; and a wind deflector positioned within said interior of said pole, said wind deflector being positioned between said motor and said solar panel wherein said wind deflector is configured to deflect the flow of air generated from said motor away from said solar panel.

2. The assembly of claim 1, further comprising a base having a top side, said pole being attached to and extending upwardly from said top side.

3. The assembly of claim 2, further comprising said base having a bottom side, a plurality of grips being attached to said bottom side, said grips being comprised of a non-slip material.

4. The assembly of claim 3, further comprising said grips comprising suction cups.

5. The assembly of claim 1, further comprising:

an upper pulley coupled to and extending outwardly from said pole proximate a top end of said pole;

a lower pulley coupled to and extending outwardly from said pole proximate a bottom end of said pole, said upper pulley being horizontally aligned relative to said lower pulley; and a rope, said rope extending between and around said upper and lower pulleys, said rope being operationally coupled to said upper and lower pulleys wherein manipulation of said rope rotates said rope about said upper and lower pulleys, said rope comprising a closed loop.

6. The assembly of claim 5, further comprising said flag being removably coupled to said rope.

7. The assembly of claim 1, further comprising a speaker mounted in said pole, said speaker being configured to emit audible sound, said speaker being operationally coupled to said processor, said control panel being operationally coupled to said processor wherein manipulation of said control buttons controls said audible sound emitted from said speaker.

8. The assembly of claim 7, further comprising an electronic memory mounted in said pole and being electrically coupled to said processor, said electronic memory being configured to store a plurality of songs thereon, the songs stored on said electronic memory being configured to comprise a plurality of flag anthems.

9. The assembly of claim 8, further comprising said control buttons comprising a pair of track selection buttons and a plurality of playback buttons, wherein manipulation of said track selection buttons is configured to transition between the songs stored on said electronic memory, wherein manipulation of said playback buttons is configured to cause said speaker to selectively play the songs stored on said electronic memory.

10. The assembly of claim 8, further comprising a display mounted to said control panel, said display being electrically coupled to said processor, said display being configured to display a name of the song being audibly emitted from said speaker.

11. The assembly of claim 7, further comprising a clock mounted to said pole, said clock being operationally coupled to said processor, said processor actuating said speaker to emit said audible sound at a selectable time of day.

12. The assembly of claim 1, further comprising a clock mounted to said pole, said clock being electronically configured for indicating the time of day.

13. The assembly of claim 1, further comprising:

a clock mounted to said pole, said clock being electronically configured for indicating the time of day, said clock being operationally coupled to said processor; and wherein said motor is operationally coupled to said processor, said processor actuating said motor to an on position at a selectable time of day.

14. The assembly of claim 1, further comprising a plurality of inlet holes positioned in said pole adjacent said motor wherein said inlet holes are configured to provide ventilation to said motor.

15. The assembly of claim 1, further comprising:

a fan shaft coupled to and extending outwardly from said motor, said fan shaft being mechanically coupled to said motor wherein actuation of said motor to an on position causes said fan shaft to rotate;

said fan blades being coupled to said fan shaft whereby said fan blades are rotated when said fan shaft is rotated such that said fan blades direct the flow of air into said interior of said pole; and a motor actuator mounted to said pole, said motor actuator actuating said motor to said on position.

16. The assembly of claim 1, further comprising wiring embedded in a side wall of said pole, said wiring electrically coupling said rechargeable battery to said solar panel, said wiring electrically coupling said processor to each of said solar panel and said rechargeable battery.

17. A flag-blowing flagpole assembly comprising:

a base having a top side and a bottom side;

a pole attached to and extending upwardly from said top side;

a plurality of grips attached to said bottom side, each of said grips being comprised of a non-slip material, said grips comprising suctions cups;

an upper pulley coupled to and extending outwardly from said pole proximate a top end of said pole;

a lower pulley coupled to and extending outwardly from said pole proximate a bottom end of said pole, said upper pulley being horizontally aligned relative to said lower pulley;

a rope, said rope extending between and around said upper and lower pulleys, said rope being operationally coupled to said upper and lower pulleys wherein manipulation of said rope rotates said rope about said upper and lower pulleys, said rope comprising a closed loop;

a flag removably coupled to said rope;

a speaker mounted in said pole, said speaker being configured to emit audible sound;

a control panel mounted to said pole, said control panel comprising a plurality of control buttons, said control buttons comprising a pair of track selection buttons and a plurality of playback buttons;

a processor mounted in said control panel, said speaker being operationally coupled to said processor, said control panel being operationally coupled to said processor wherein manipulation of said control buttons controls said audible sound emitted from said speaker;

an electronic memory mounted in said pole and being electrically coupled to said processor, said electronic memory being configured to store a plurality of songs thereon, the songs stored on said electronic memory being configured to comprise a plurality of flag anthems, wherein manipulation of said track selection buttons is configured to transition between the songs stored on said electronic memory, wherein manipulation of said playback buttons is configured to cause said speaker to selectively play the songs stored on said electronic memory;

a display mounted to said control panel, said display being electrically coupled to said processor, said display being configured to display a name of the song being audibly emitted from said speaker;

a clock mounted to said pole, said clock being electronically configured for indicating the time of day, said clock being operationally coupled to said processor, said processor actuating said speaker to emit said audible sound at a selectable time of day;

a covering positioned around said clock, said covering being water-proof;

a motor positioned within an interior of said pole, said motor being operationally coupled to said processor;

a fan shaft coupled to and extending outwardly from said motor, said fan shaft being mechanically coupled to said motor wherein actuation of said motor to an on position causes said fan shaft to rotate;

a plurality of fan blades, said fan blades being coupled to said fan shaft whereby said fan blades are rotated when said fan shaft is rotated such that said fan blades direct a flow of air into said interior of said pole;

a motor actuator mounted to said pole, said motor actuator actuating said motor to said on position, said motor actuator being operationally coupled to said processor;

a plurality of inlet holes positioned in said pole adjacent said motor wherein said inlet holes are configured to provide ventilation to said motor;

a plurality of outlet holes positioned in said pole, said outlet holes being positioned proximate said top end of said pole, said flag being configured for positioning adjacent said outlet holes wherein said outlet holes permit the air generated from said fan blades to flow from said interior of said pole through said outlet holes onto said flag, said outlet holes being arranged into a plurality of rows;

a power supply mounted in said base, said power supply being electrically coupled to each of said processor, said motor and said motor actuator wherein said power supply is configured to deliver power to each of said motor, said processor and said motor actuator, said power supply including at least one rechargeable battery;

a compartment extending into said top side of said base, said compartment being configured to store said rechargeable battery;

a solar panel attached to said pole, said solar panel being attached to said top end of said pole, said solar panel being electrically coupled to said rechargeable battery wherein said solar panel recharges said rechargeable battery;

wiring embedded in a side wall of said pole, said wiring electrically coupling said rechargeable battery to said solar panel, said wiring electrically coupling said processor to each of said solar panel and said rechargeable battery; and a wind deflector positioned within said interior of said pole, said wind deflector being positioned between said motor and said solar panel wherein said wind deflector is configured to deflect the flow of air generated from said motor away from said solar panel.

* * * * *